US009033682B2

(12) United States Patent
Thalmann

(10) Patent No.: US 9,033,682 B2
(45) Date of Patent: May 19, 2015

(54) HAND PUMP FOR PRIMING A FUEL OR FILTER SYSTEM

(75) Inventor: Christian Thalmann, Speyer (DE)

(73) Assignee: Mann+Hummel GMBH, Ludwigsburg (DE)

( * ) Notice: Subject to any disclaimer, the term of this patent is extended or adjusted under 35 U.S.C. 154(b) by 313 days.

(21) Appl. No.: 13/500,547

(22) PCT Filed: Aug. 26, 2010

(86) PCT No.: PCT/EP2010/062479

§ 371 (c)(1),
(2), (4) Date: May 21, 2012

(87) PCT Pub. No.: WO2011/042252

PCT Pub. Date: Apr. 14, 2011

(65) Prior Publication Data

US 2012/0219441 A1 Aug. 30, 2012

(30) Foreign Application Priority Data

Oct. 5, 2009 (DE) ..... 10 2009 048 211

(51) Int. Cl.

| | |
|---|---|
| ***F04B 45/00*** | (2006.01) |
| ***F04B 17/00*** | (2006.01) |
| ***F04B 35/04*** | (2006.01) |
| ***F02M 1/16*** | (2006.01) |
| ***F02M 37/16*** | (2006.01) |
| ***F04B 9/14*** | (2006.01) |

(Continued)

(52) U.S. Cl.

CPC ..... *F02M 37/16* (2013.01); *F02M 37/22* (2013.01); *F04B 9/14* (2013.01); *F04B 43/0063* (2013.01); *F04B 43/023* (2013.01)

(58) Field of Classification Search

CPC ..... F04B 9/00; F04B 33/00; F04B 39/127; F02M 1/16; F02M 37/16; F02N 3/00

USPC ..... 417/412, 413.1, 394, 395, 423.9; 123/179.9, 179.11, 510, 511

See application file for complete search history.

(56) References Cited

U.S. PATENT DOCUMENTS 3,805,758 A * 4/1974 May ..... 123/495
4,204,511 A * 5/1980 Morris ..... 123/179.11

(Continued)

FOREIGN PATENT DOCUMENTS

DE 131869 A5 7/1978
DE 3203635 C1 3/1983

(Continued)

OTHER PUBLICATIONS

PCT search report for PCT/EP2010/062479.

*Primary Examiner* — Bryan Lettman
*Assistant Examiner* — Timothy P Solak
(74) *Attorney, Agent, or Firm* — James Hasselbeck

(57) ABSTRACT

A hand pump (16) includes a housing (22) having an inlet (18) and an outlet (26) and an actuating body (32) movably mounted in the housing axially and a membrane (46) with a flexible ring section (48) surrounding the stroke axis (34). During stroke movement, the actuating body (32) is pressed with the membrane (46) against the force of an elastic element (42) from a resting position (I) into the pump housing (22) and into an actuating position, and returned to the resting position (I) by the elastic element (72). Thus, the volume of a pump chamber (20) can be modified.

10 Claims, 3 Drawing Sheets

(51) Int. Cl.

| | |
|---|---|
| ***F04B 43/00*** | (2006.01) |
| ***F04B 43/02*** | (2006.01) |
| *F02M 37/22* | (2006.01) |

(56) References Cited

U.S. PATENT DOCUMENTS

| | | | | | |
|---|---|---|---|---|---|
| 4,319,570 | A * | 3/1982 | Grane | ..... | 604/317 |
| 5,362,392 | A * | 11/1994 | Jensen | ..... | 210/249 |
| 6,019,890 | A * | 2/2000 | Janik et al. | ..... | 210/117 |
| 2008/0135426 | A1 * | 6/2008 | Hecht et al. | ..... | 206/223 |

FOREIGN PATENT DOCUMENTS

| | | | |
|---|---|---|---|
| DE | 10208425 | A1 | 10/2002 |
| DE | 202008007700 | U1 | 10/2009 |

* cited by examiner

HAND PUMP FOR PRIMING A FUEL OR FILTER SYSTEM

CROSS REFERENCE TO RELATED APPLICATIONS

This application is US National Stage Entry of international patent application no. PCT/EP2010/062479, filed Aug. 26, 2010 designating the United States of America, the entire disclosure of which is incorporated herein by reference. Priority is claimed based on German patent application no. 10 2009 048 211.3 filed on Oct. 5, 2009.

TECHNICAL FIELD

The invention concerns a hand pump for pumping fluids, in particular fuel, in particular of a motor vehicle, comprising a pump housing that has an inlet and an outlet for the fluid and an actuating member that is supported therein so as to be axially moveable relative to a stroke axis as well as a membrane with a flexible ring section that surrounds the stroke axis, wherein the ring section is attached radially inwardly in a fastening area of the actuating member and radially outwardly in a holding area of the pump housing, wherein the actuating member with the membrane is forced against the force of an elastic element from a rest position into an actuating position into the pump housing upon a stroke movement and by means of the elastic element is returned into the rest position and, in this way, the volume of the pump chamber can be changed, wherein a stroke height of the actuating member is greater than a smallest radial spacing between the holding area and the fastening area during a stroke.

The invention concerns moreover a filter system for fluids, in particular fuels, in particular of a motor vehicle, comprising a hand pump for pumping the fluids, with a pump housing and an actuating member that is supported therein so as to be axially moveable relative to a stroke axis as well as a membrane with a flexible ring section that surrounds the stroke axis, wherein the ring section is attached with a radially inwardly positioned side in a fastening area of the actuating member and with a radially outwardly positioned side in a holding area of the pump housing, wherein the actuating member with the membrane is forced against the force of an elastic element from a first end position into a second end position into the pump housing upon a stroke movement and by means of the elastic element is returned into the first end position and, in this way, the volume of a pump chamber can be changed, wherein a stroke height of the actuating member is greater than a smallest radial spacing between the holding area and the fastening area during a stroke.

PRIOR ART

Fuel supply systems for internal combustion engines are often provided with hand pumps of the aforementioned kind that have the purpose of facilitating the starting operation when the tank has been run empty or after exchange of a fuel filter. Such hand pumps are often combined constructively with a filter head to be connected to the fuel filter.

U.S. Pat. No. 6,019,890 A discloses a hand pump for conveying fuel in a fuel supply system wherein the hand pump is constructively combined with a fuel filter. A housing bottom part of the fuel pump is formed integrally with the connecting head for the fuel filter. On the housing bottom part a lid is attached by means of a securing ring. In a securing area between the housing bottom part and the lid, the circumferential wall of a membrane is clamped that extends substantially along the inner side of the lid. A radial inner area of the membrane is clamped in a fastening area between the lower plate of a knob and a support plate. For pumping, the knob is pressed against a spring pretension and reduces in this way the volume of a pump chamber. In this connection, the fastening area remains on one side of the holding area so that the stroke height is correspondingly limited and a large portion of the possible stroke volume remains unused.

The invention has the object to provide a hand pump and a filter system with a hand pump of the aforementioned kind in such a way that a stroke volume as large as possible is realized with a constructive space as small as possible.

SUMMARY OF THE INVENTION

This object is solved according to the invention in that the holding area of pump housing, axially viewed relative to the stroke axis, is positioned between the position of the fastening area in the rest position and the position of the fastening area in the actuating position.

According to the invention, the fastening area of the actuating member is thus moved past the holding area when a stroke is performed. In this way, the freedom of movement of the membrane is optimally utilized and, in this way, the stroke volume that is achievable for the predetermined constructive space is maximized. Since the stroke height is greater than the smallest possible spacing between the holding area and the fastening area, the gap between a radial inner circumferential side of the pump housing and a radial outer circumferential side of the actuating member is minimized. Preferably, the width of the gap is less than 5 mm. The membrane is optimally supported with respect to the changing pressure loads by the fastening area with a diameter that is as large as possible; this has a positive effect on the stroke volume. Upon intake of the fluid, in the pump chamber underpressure exists relative to a pressure in the fluid supply conduit. Upon pumping fluid out of the pump chamber, an overpressure exists relative to a pressure in a fluid discharge line.

In an advantageous embodiment, the holding area of the pump housing can be positioned centrally between the position of the fastening area in the rest position and the position of the fastening area in the actuating position of the actuating member. In this way, the axial deflection of the actuating member is identical on both sides of the holding area so that the stroke height can be maximized and the available constructive space is utilized optimally.

Advantageously, the ring section of the membrane can be curved and evertable; in particular, the membrane can be a rolling membrane. In this way it is possible that the ring section, when passing the holding area, can be everted with minimal force expenditure in the gap between the fastening area in the holding area. A rolling membrane can be simply everted even for minimal gap widths.

The membrane can advantageously be comprised of an elastomer. Elastomers are flexible, robust, and moreover can be simply configured to have complex shapes.

Advantageously, the membrane can have a circumferentially extending sealing bead that is clamped between a lid and a housing bottom part of the pump housing. In this way, an excellent sealing action between the membrane and the pump housing is achieved so that the escape of fluid the holding area is prevented.

According to a further advantageous embodiment, the actuating member can have an exterior cap on which or in which a support cap is arranged and the membrane can be clamped between the exterior cap and the support cap. In this connection, the membrane can be clamped flat and stably between the exterior cap and the support cap in the area of its center. A separate seal in the fastening area is thus not required.

However, there is also the possibility that the membrane is embodied as a ring element and only a radial inner area of the ring element is clamped seal-tightly between the knob and the support cap. The membrane is optimized in this way with respect to material usage.

Alternatively, advantageously the actuating member can have a knob and the membrane can be integrally injection-molded onto the knob and can be embodied as a ring element. A ring element is optimized relative to material usage. The hand pump according to the invention is comprised in this way of fewer individual parts and can therefore be mounted more easily.

Advantageously, the hand pump can be integrated in a filter system for fluids, in particular a filter head. In filter systems, it is particularly advantageous when the employed components require as little as possible mounting space. In this connection, the hand pump according to the invention with an optimal ratio between stroke volume and constructive space is particularly advantageous.

The technical object is solved according to the invention furthermore in that for the hand pump of the filter system the holding area of the pump housing, axially viewed relative to the stroke axis, is located between the position of the fastening area in the rest position and the position of the fastening area in the actuating position. The aforementioned advantages of the hand pump according to the invention apply likewise to the filter system according to the invention.

BRIEF DESCRIPTION OF THE DRAWINGS

Further advantages, features and details of the invention result from the following description in which an embodiment of the invention will be explained in more detail with the aid of the drawing. A person of skill in the art will consider features disclosed in combination in the drawing, the description and the claims also individually and combine them to expedient further combinations. It is shown in:

In the Figures, same components are provided with the same reference characters.

EMBODIMENT(S) OF THE INVENTION

Figure 1:
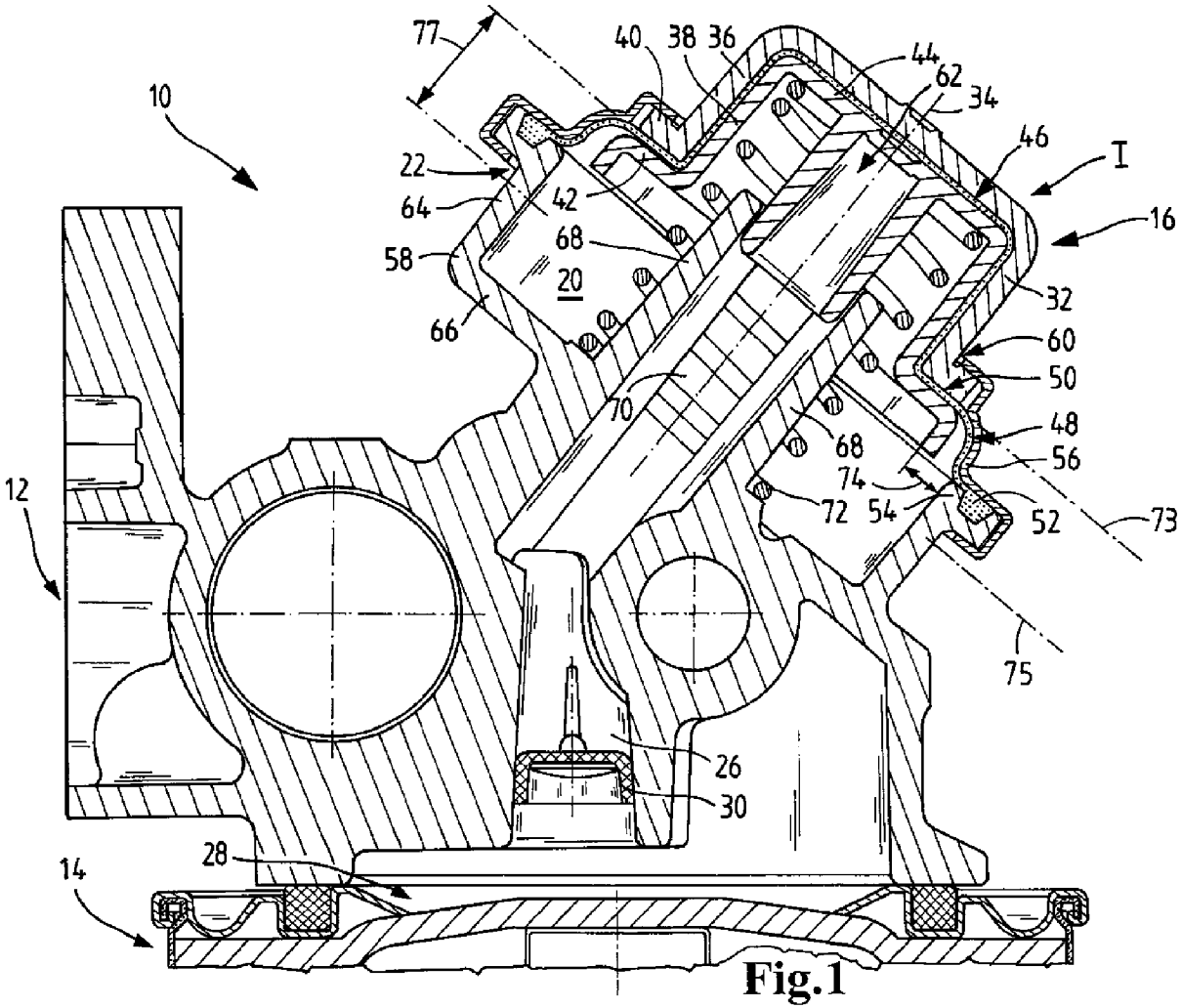
FIG. 1 schematically a section of a hand pump integrated into a filter head of a fuel filter system.

In FIG. 1, a detail of a fuel filter system 10 of an internal combustion engine of a motor vehicle is illustrated. The fuel filter system 10 comprises a filter head 12 on which an exchangeable filter 14, of no interest in this context, is mounted.

A hand pump 16 is integrated into the filter head 12. The hand pump 16 serves for manually sucking in fuel from a tank, for example, after exchange of the exchangeable filter 14 or before restarting the internal combustion engine when the tank has run empty.

Figure 3:
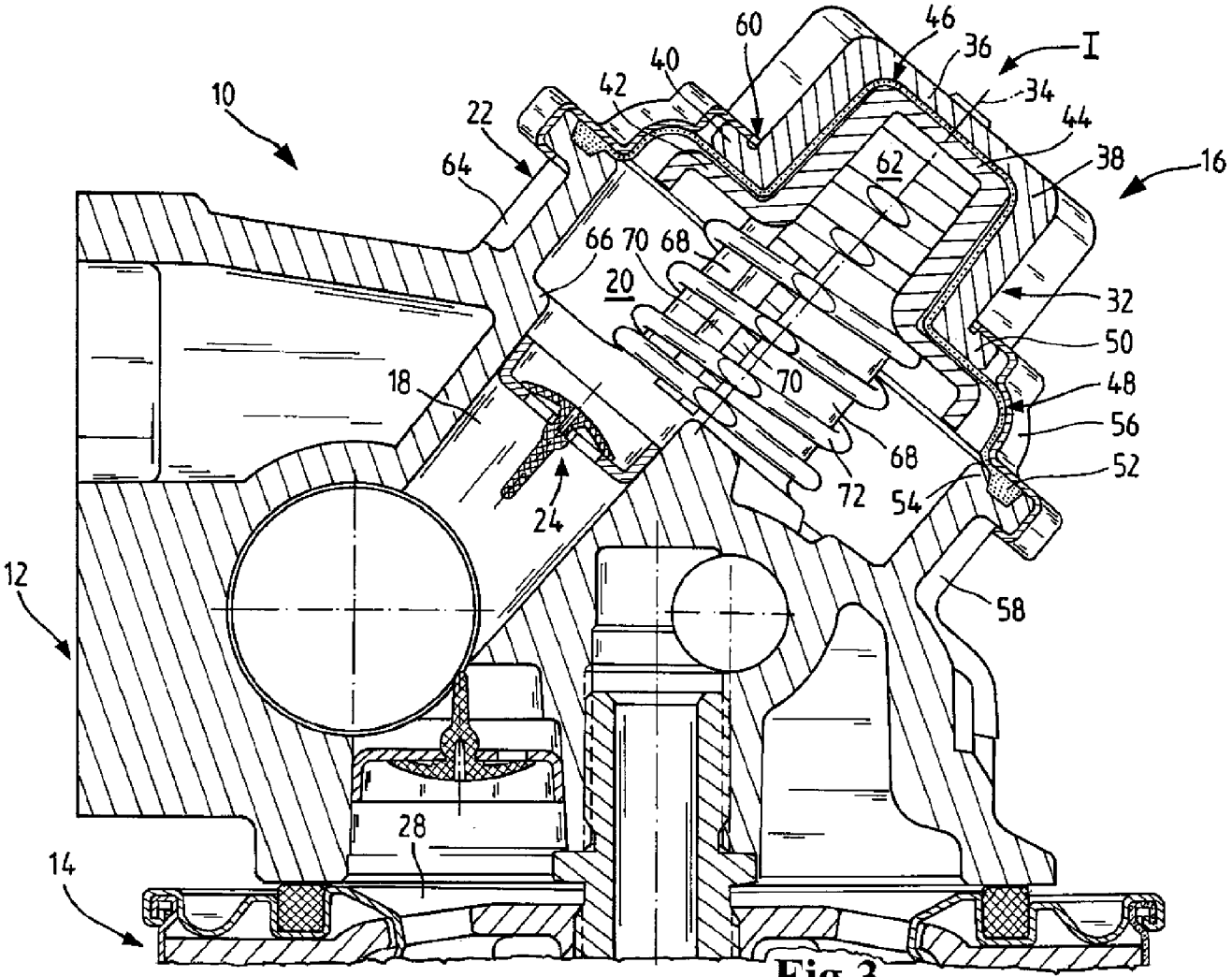
FIG. 3 schematically a different section of the hand pump of FIG. 1.

In the filter head 12, an intake line 18 of the hand pump 16 is arranged. The intake line 18 is visible in the section view of FIG. 3. The intake line 18 is connected with a fuel supply line, coming from the tank and not illustrated in the Figures, and opens into a pump chamber 20 of a pump housing 22 of the hand pump 16. In the intake line 18 an inlet check valve 24 is arranged that opens for sucking in fuel into the pump chamber 20.

Figure 2:
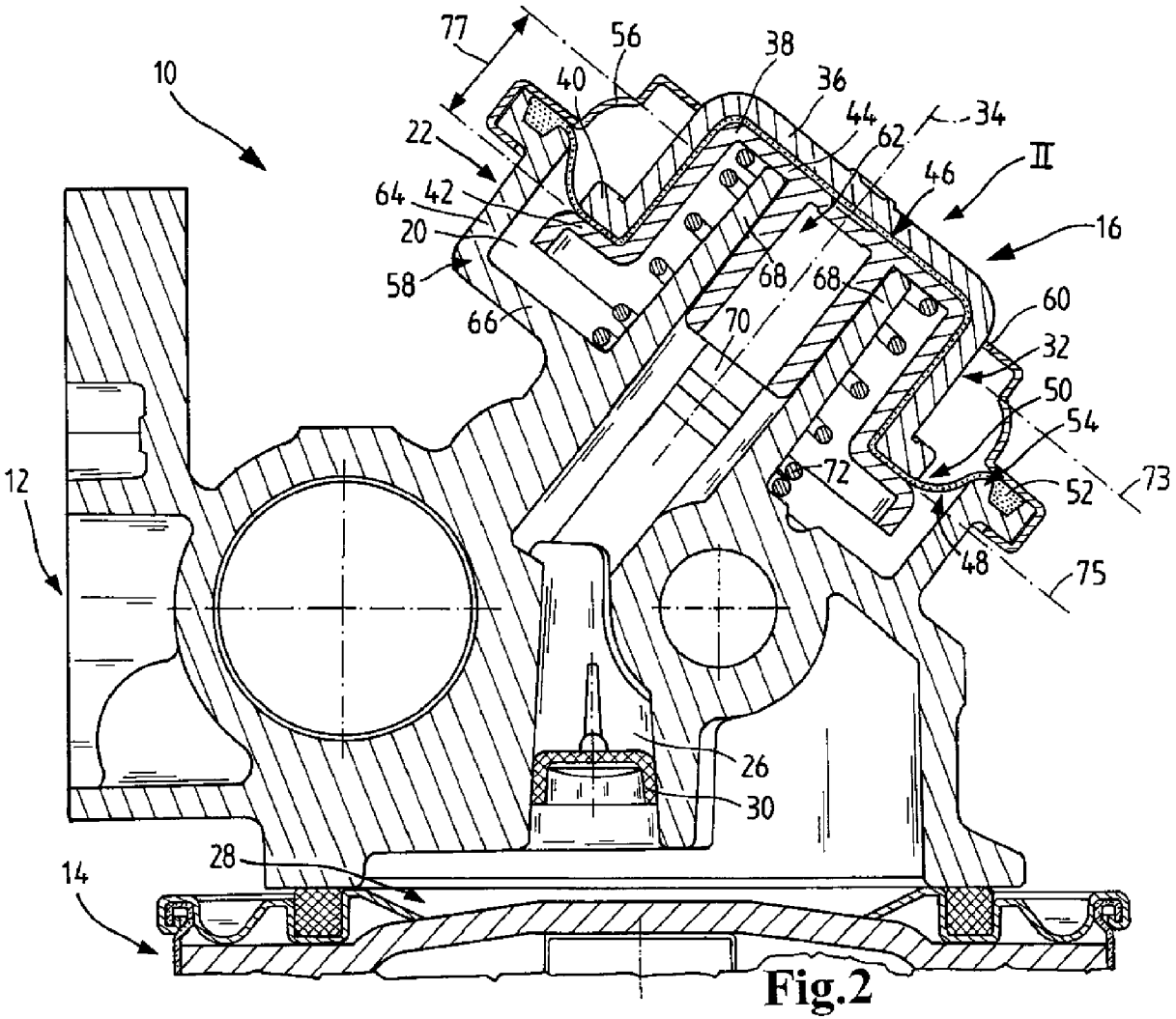
FIG. 2 schematically a section of the hand pump of FIG. 1 during actuation.

A pressure line 26 of the hand pump 16 that is shown in FIGS. 1 and 2 connects the pump chamber 20 with an inlet 28 of the exchangeable filter 14. In the pressure line 26 an outlet check valve 30 is arranged which opens for pumping fuel from the pump chamber 20 into the exchangeable filter 14.

In the pump housing 22 a knob 32, identified as a whole by reference character 32, is supported such that it is axially movable relative to the stroke axis 34. The knob 32 is comprised of an exterior cap 36 and a support cap 38.

The exterior cap 36 as a whole is approximately cup-shaped. On the free end face of the exterior cap 36 a radial flange 40 is integrally formed. The support cap 38 is also approximately cup-shaped. It has at its free end face a radial counter flange 42 whose radial outer rim is bent away at a right angle from the bottom 44 of the support cap 38. The support cap 38 is inserted into the exterior cap 36 wherein an approximately cup-shaped membrane 46 of rubber that is of a stepped configuration at its circumferential side is clamped between the support cap 38 and the exterior cap 36.

A curved ring section 48 of the membrane 46 surrounds a fastening area 50 of the knob 32 provided for the membrane 46 between the flange 40 and the counter flange 42.

The ring section 48 has at the radial outer rim of the membrane 46 a circumferentially extending sealing bead 52. The sealing bead 52 is clamped in a holding area 54 between a lid 56 and an upper edge of a housing bottom part 58 of the pump housing 22 and, in this connection, assumes at the same time a sealing function. The pump housing 22 is sealed-tightly closed by crimping of the lid 56 on the rim.

The knob 32 that is provided with the membrane 46 projects through an opening 60 in the lid 56 outwardly wherein the radial flange 40 is resting at the inner side of the lid 56. The ring section 48 of the membrane 46 extends from the holding area 54 to the fastening area 50 and is resting on the lid 56 in the rest position I of the knob 32 shown in FIGS. 1 and 3.

The cylinder section 62 extends away from the inner side of the bottom 44 of the support cap 38 and is concentric to the stroke axis 34. The axial extension of the cylinder section 62 corresponds approximately to the axial extension of the support cap 38.

The housing bottom part 50 comprises a cylindrical wall section 64 having at its lower end a bottom 66. The bottom 66, the cylindrical wall section 64, the membrane 46, and the knob 32 delimit the pump chamber 20 whose volume is changeable by pressing down the knob 32 and the corresponding movement of the membrane 46.

On the bottom 66, in concentric alignment to the cylinder section 62 of the support cap 38, two guide elements 68 are provided. The cylinder section 62 is located in a cylindrical interior that is delimited by the guide elements 68. The guide elements 68 are separated from each other across their entire length in the direction of the stroke axis 34 by two passage slots 70 that are aligned in the FIGS. 1 and 2. By means of the passage slots 70 fuel can pass from the area of the pump chamber 20 surrounded by the guide elements 68 into the interior.

The guide elements 68 and the cylinder section 62 are surrounded by a spiral pressure spring 72. The spiral pressure spring 72 is supported with one end on the inner side of the bottom 66 of the housing bottom part 58 and with the other end on the inner side of the bottom 44 of the support cap 38.

For pumping fuel, the knob 32 with the membrane 46 is pressed against the force of the spiral pressure spring 72 into the pump chamber 20 from the rest position I into an actuating position II that is shown in FIG. 2. In FIG. 1, the position of the fastening area 50 in the rest position I is shown as a straight dashed line 73 and the actuating position II is indicated by a straight dashed line 75. The holding area 54 of the pump housing 22 is positioned, viewed axially relative to the stroke axis 34, centrally between the position 73 of the fastening area 50 in the rest position I and the position 75 of the fastening area 50 in the actuating position II of the knob 32. In this way, the flexibility of the membrane 46 is completely utilized and a greatest possible stroke height, indicated in FIG. 1 by double arrow 77, is achieved so that thereby a greatest possible stroke volume is achieved. The stroke height 77 of the knob 32 is greater than the smallest possible spacing between the holding area 54 and the fastening area 50 during a stroke. The width that is indicated in FIG. 1 by the double arrow 74 of the gap 74 that remains between the holding area 54 and the fastening area 50 is preferably less than 5 mm.

Upon suppression of the knob 32, the ring section 48 of the membrane 46 that is embodied as a rolling membrane is everted by means of a rolling shape change. The volume of the pump chamber 20 is reduced and the pressure in the pump chamber 20 increases. This pressure increase causes opening of the outlet check valve 30 so that fuel from the pump chamber 20 is pumped through the pressure line 26.

After termination of the downward stroke of the knob 32, the force loading by the hand of the operating person ends also. As a result of the restoring force, the spiral pressure spring 72 pushes the knob 32 out of the pump chamber 20 until the radial flange 40 rests on the lid 56. In this way, the ring section 48 of the membrane 46 is everted into its original shape. The volume of the pump chamber 20 is increased and underpressure is produced. The underpressure effects opening of the inlet check valve 24 so that fuel flows through the intake line 18 into the pump chamber 20.

In the above described embodiment of a fuel filter system 10 and a hand pump 16 the following modifications are possible inter alia.

The fuel filter system 10, in particular the hand pump 16, is not limited to use in internal combustion engines in the automotive field. Instead, it can be used also in other internal combustion engines, for example, industrial motors. The fuel filter system 10 and the hand pump 16 can also be used in other technical fields, for example, in water technology for filtering or for sucking in water.

Instead of being integrated into the filter head 12, the hand pump 16 can also be configured as a separate functional component. The hand pump 16 can also be arranged at a different location in the fuel filter system 10.

Instead of being arranged centrally between the respective position 73 or 75 of the fastening area 50 in the rest position I and the actuating position II, the holding area 54 of the pump housing 22, can also be positioned closer to one of the positions 73 or 75.

The membrane 46, instead of being made of rubber, can also be made of different types of flexible material, in particular a different kind of elastomer.

The support cap 38, instead of being inserted into the exterior cap 46, can also be pushed onto it.

The membrane 46, instead of being clamped between exterior cap 36 and support cap 38, can also be injection-molded onto an appropriate knob and can be embodied as a ring element.

Instead of the knob 32 with exterior cap 36 and support cap 38, a different knob, in particular a monolithic one, can be provided.

Instead of the spiral pressure spring 72 also a different kind of spring or a different kind of elastic element can be provided.

The invention claimed is:

1. A hand pump for pumping fluid of a motor vehicle, comprising:

a pump housing, including a fluid inlet;

a fluid outlet;

an actuating member arranged within said pump housing and supported therein so as to be axially moveable relative to a stroke axis;

a membrane with a flexible ring section surrounding the stroke axis, that is fastened radially inwardly in a fastening area of the actuating member and radially outwardly in a holding area of the pump housing;

wherein the actuating member with the membrane upon a stroke movement against the force of an elastic element is pressed from a rest position (I) into an actuating position (II) into the pump housing and by means of the elastic element is returned into the rest position (I) and in this way the volume of a pump chamber can be changed, wherein a stroke height of the actuating member is greater than a smallest radial spacing between the holding area and the fastening area upon a stroke movement, wherein the holding area of the pump housing is positioned axially between the fastening area rest position in the rest position (I) and the fastening area actuating position in the actuating position (II);

wherein the actuating member has an exterior cap on or in which a support cap is arranged and the membrane is clamped between the exterior cap and the support cap;

a first axially extending cylindrical guide element formed on an interior surface of a housing bottom part at the bottom of pump chamber and extending axially towards the support cap, the first cylindrical guide element having an axially extending open interior connected to the fluid outlet;

wherein the first axially extending cylindrical guide element includes fluid passage slots extending radially through the wall of the first cylindrical guide element from the axially extending open interior into the pump chamber, the fluid passage slots passing fuel through the first cylindrical guide element from the pump chamber to the axially extending open interior and on to the fluid outlet;

wherein the support cap includes a second axially extending cylindrical guide element, the second axially extending cylindrical guide element sliding axially in the first axially extending cylindrical guide element as the actuating member moves from the rest position (I) to the actuating position (II).

2. The hand pump according to claim 1, wherein the ring section of the membrane is curved and can be everted, wherein the membrane is a rolling membrane.

3. The hand pump according to claim 1, wherein the membrane is comprised of an elastomer.

4. The hand pump according to claim 1, wherein the membrane has a circumferentially extending sealing bead that is clamped between a lid and a housing bottom part of the pump housing.

5. The hand pump according to claim 1, wherein the actuating member comprises a knob and the membrane is injection-molded onto the knob and is embodied as a ring element.

6. The hand pump according to claim 1, wherein the hand pump is integrated into a filter head of a filter system.

7. A filter system for fluids of a motor vehicle, comprising a hand pump according to claim 1.

8. The hand pump according to claim 1, wherein the holding area of the pump housing is centrally positioned between the position of the fastening area in the rest position (I) and the position of the fastening area in the actuating position (II) of the actuating member.

9. The hand pump according to claim 8, wherein the ring section of the membrane is curved and can be everted, wherein the membrane is a rolling membrane, wherein the membrane is comprised of an elastomer, wherein the membrane has a circumferentially extending sealing bead that is clamped between a lid and a housing bottom part of the pump housing, wherein the actuating member has an exterior cap on or in which a support cap is arranged and the membrane is clamped between the exterior cap and the support cap, and wherein the actuating member comprises a knob and the membrane is injection-molded onto the knob and is embodied as a ring element.

10. The hand pump according to claim 9, wherein the hand pump is integrated into a filter head of a filter system.

* * * * *